US011253096B2

(12) United States Patent
Bartley-Clark

(10) Patent No.: US 11,253,096 B2
(45) Date of Patent: Feb. 22, 2022

(54) SECURABLE DELIVERY CONTAINER FOR TEMPORARILY SECURELY STORING DELIVERIES AND LIMITING ACCESS

(71) Applicant: Donna Bartley-Clark, Norman, OK (US)

(72) Inventor: Donna Bartley-Clark, Norman, OK (US)

( * ) Notice: Subject to any disclaimer, the term of this patent is extended or adjusted under 35 U.S.C. 154(b) by 6 days.

(21) Appl. No.: 16/543,036

(22) Filed: Aug. 16, 2019

(65) Prior Publication Data

US 2021/0045563 A1 Feb. 18, 2021

(51) Int. Cl.

| | |
|---|---|
| ***A47G 29/14*** | (2006.01) |
| ***A47G 29/30*** | (2006.01) |
| ***A47G 29/20*** | (2006.01) |

(52) U.S. Cl.

CPC ..... *A47G 29/141* (2013.01); *A47G 29/20* (2013.01); *A47G 29/30* (2013.01); *A47G 2029/147* (2013.01)

(58) Field of Classification Search

CPC ..... A47G 29/141; A47G 29/20; A47G 29/30
See application file for complete search history.

(56) References Cited

U.S. PATENT DOCUMENTS

| | | | | |
|---|---|---|---|---|
| 2016/0058181 | A1 | 3/2016 | Han et al. | |
| 2017/0127868 | A1 | 5/2017 | Adewuyi | |
| 2017/0228692 | A1 | 8/2017 | Pargoe | |
| 2020/0397172 | A1 * | 12/2020 | Kennett | E05B 65/52 |

* cited by examiner

*Primary Examiner* — Curtis B Odom
(74) *Attorney, Agent, or Firm* — Edward L. White

(57) ABSTRACT

A securable delivery container for temporarily securely storing deliveries and limiting access comprising a container having a bottom, a plurality of walls a receiving compartment defined therein, a lid attachment, a lid for accessing the compartment, and a compartment anchor point for securing a deployable external compartment, a temperature controlled compartment, a lock, a deployable external compartment for deliveries with one receiving compartment defined therein, and a lock for the external compartment, whereby a delivery person unlocks the securable delivery container, places a package, inside the container and locks the container unless the package is too large or an odd shape that will not fit in the securable delivery container, then a delivery person deploys the external compartment and places the odd package inside the external compartment and secures the delivery to securable delivery container, closes the lid, and locks the securable delivery container locking the external container.

57 Claims, 8 Drawing Sheets

SECURABLE DELIVERY CONTAINER FOR TEMPORARILY SECURELY STORING DELIVERIES AND LIMITING ACCESS

CROSS-REFERENCE TO RELATED APPLICATIONS

None

FIELD OF THE INVENTION

The invention generally relates to an apparatus for receiving and securely storing deliveries from services such as United States Postal Service (USPS), Federal Express (FedEx®), United Parcel Service (UPS®), Amazon®, local restaurants, until retrieved by the owner. In particular, the invention relates to an apparatus for receiving, and temporarily storing a delivery in a temperature-controlled environment and securing oversized deliveries until the owner is able to the retrieve the delivery.

BACKGROUND

Deliveries are made daily throughout the world. These deliveries come in many forms, but the most common are items shipped in packages. These packages come in varying shapes and sizes. Deliveries of packages made by USPS are typically placed in the owner's mailbox, which may or may not be secured, if the package will fit in the mailbox. If not, USPS may leave a notice for the owner to come to the post office to retrieve the package or the next available delivery time for package to be delivered to the owner thus requiring the owner to be there to receive the package. Delivery services may leave the deliveries at a place of business or the porch of a residence that is typically unsecured. This practice has led to a booming industry for thieves, who are affectionately known as "porch pirates." The porch pirates take advantage of the situation when they see deliveries sitting in the open and unattended. They gamble on what is inside and steal the package. Porch pirates have become so bold as to follow a delivery vehicle, stay out of sight, then immediately pick up the delivery after the delivery vehicle has departed the area. Over the holidays, millions of packages were reported stolen, and that was over a small window of time. As society increases its convenience desires, more deliveries will be made to businesses and residences, only to be stolen by porch pirates. There are a few solutions that have been employed to combat the porch pirate problem including, but not limited to, requiring a signature, having the delivery made at the owner's place of work if possible, or having the delivery go to a neighbor's or friend's residence. As for the signature requirement, someone must sign for the delivery whether it be the owner, which if delivered at the owner's place of business may require permission from the business or the owner's designee, which may be inconvenient. In the case of a neighbor or a friend, the owner is at the mercy of the neighbor's or friend's schedule. These solutions present other problems, which are significant to a society that is seeking more convenience every day. Selecting these alternative solutions for pickup and delivery is counter to the convenience desired.

The environment is another issue related to leaving packages at a business or residence. The package may be susceptible to not only theft but the environment including, but not limited to, heat, rain, snow, etc. Adding home security devices, such as surveillance cameras may help deter porch pirates but still the package is still susceptible to the environment and theft.

Another solution to mitigate the porch pirate theft problem is a lockable container. A lockable container may secure the delivery, but a lockable container presents a new set of problems. If the lock requires a key, any delivery service used would need a key thus presenting a two-fold problem: 1) every delivery driver for every delivery service would need a key for every lockable container on their route thus creating an unmanageable situation for the delivery service and leading to inefficiencies and no cooperation; and 2) the owner could potentially lose control of who has access to the lockable container. Therefore, a keyed lockable container would not be an acceptable solution for the delivery companies and the owner.

Additionally, the combination lock, whether a mechanical or electronic lockable container presents a similar set of problems. The delivery person would have to maintain set of combinations for each container for each person. A biometric lock would require the owner to acquire biometric data from each delivery person that may deliver to the residence or business. Gathering biometric data would be problematic considering potential privacy issues and the delivery driver not being the same delivery driver every time.

Another current limitation of the current lockable containers is that they are designed to receive only packages and not perishable items including, but not limited to, medicines and food items because of the temperature control required. For example, the owner cannot order a pizza, and have it delivered to the residence, while they are enroute to the residence where the pizza is to be delivered. For the reasons above, the current art is bereft of an adequate solution to delivery problems.

SUMMARY OF THE INVENTION

The present invention overcomes these shortcomings by providing a securable delivery container with a temperature controllable internal compartment and a deployable external compartment for securing oversized deliveries that cannot be stored in the internal compartment. The delivery may contain a wide variety of items that may require secure storage until the owner is able to retrieve the delivery including, but not limited to, prescriptions and ammunition. Additionally, the securable delivery container may be accessed by multiple users from delivery services, including, but not limited to, USPS, FedEx®, UPS®, Amazon®, and local restaurants to deliver and securely store the delivery until the owner is able to retrieve the delivery. The securable delivery container may comprise a container with a temperature-controlled compartment, a lid for accessing the compartment, an anchor point to prevent removal, a cable lock, a deployable external compartment for oversized deliveries and an external compartment lock.

There have thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods, and systems for carrying out the several purposes of the present invention. Additional benefits and advantages of the present invention will become apparent to those skilled in the art to which the present invention relates from the subsequent description of the preferred embodiment and the appended claims, taken in conjunction with the accompanying drawings. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

DESCRIPTION OF THE DRAWINGS

FIG. 6 is an inside view of a divided securable delivery container receiving compartment with external compartment deployed.

DETAILED DESCRIPTION OF THE INVENTION

Figure 1:
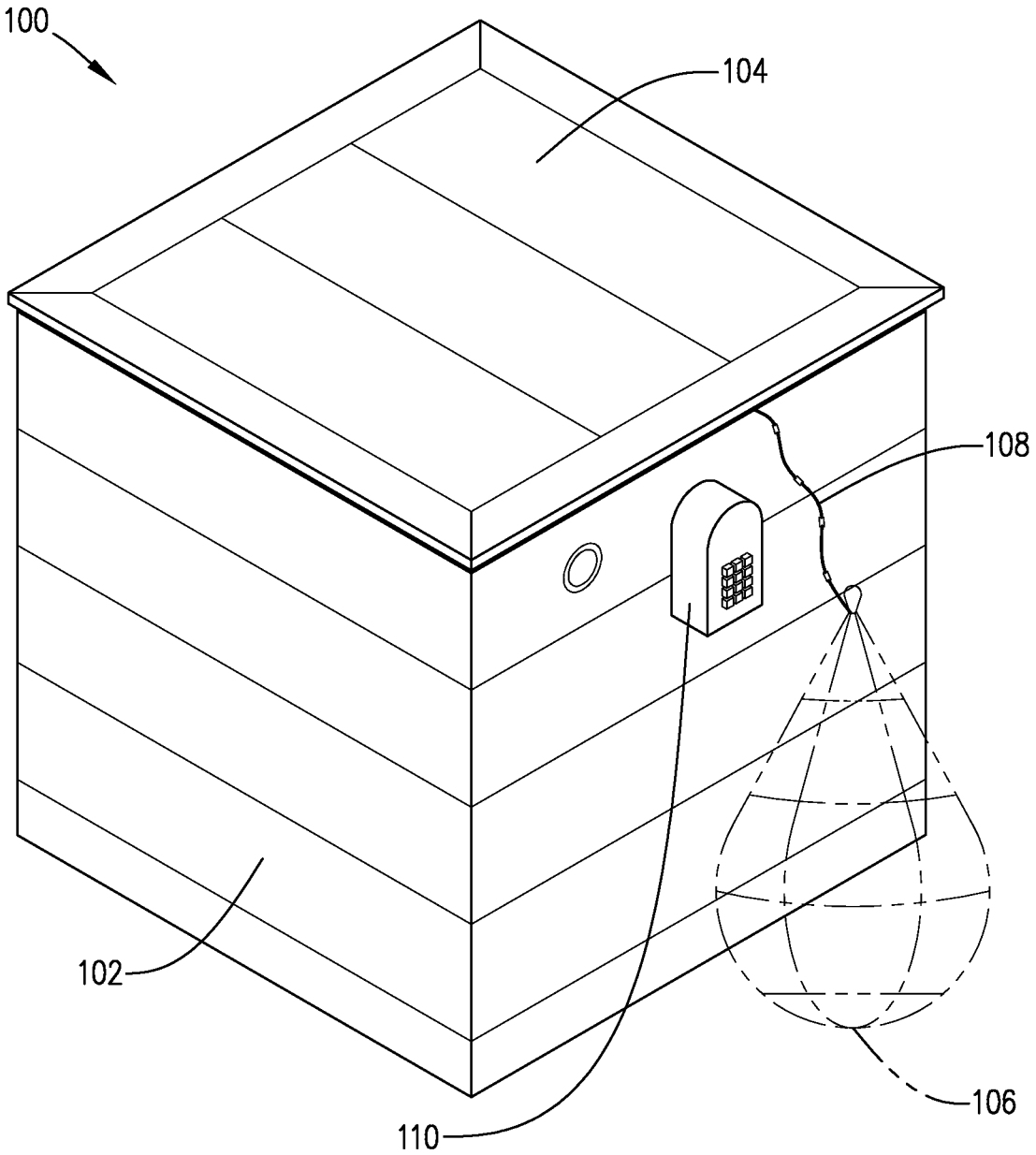
FIG. 1 is a perspective view of a closed securable delivery container.

FIG. 1 is a perspective view of a closed securable delivery container 100. The deliver container 100 may comprise an enclosure 102, a lid 104, a deployable external compartment 106, a security cable 108, and an external lock 110. In the preferred embodiment, the lid 104 may be hingedly affixed to the enclosure 102. An owner is one that can fully control the securable delivery container 100. A user may be either an owner or person that has limited access to the securable delivery container 100 for delivery purposes. The user may raise the lid 104 to a vertical position from a horizontal position as shown, wherein the lid 104 substantially covers the enclosure 102. In the preferred embodiment, the lid 104 may extend slightly past the enclosure 102 on all sides to prevent intrusion into the receiving compartment 204 by environmental elements including, but not limited to, rain, snow, dirt, and debris.

In an alternative embodiment, the lid 104 may be slidingly attached to the enclosure 102. The user may slide the lid 104 horizontally away from the enclosure 102 and revealing the receiving compartment 204. The user may then close the enclosure 102 by sliding the lid 104 in the opposite horizontal direction covering the receiving compartment 204. In another embodiment, the lid 104 may be rollably attached to the enclosure 102, where the user rolls the lid 104, similar to a garage door, to provide access to the receiving compartment 204. To cover the receiving compartment 204, the user then reverses the action of the lid 104 to cover to receiving compartment 204. One skilled in the art may select one of these embodiments depending on the environment the securable delivery container 100 is to be used.

One skilled in the art may construct the lid 104 from materials selected from ferrous and non-ferrous metals, composites, carbon fiber, fiberglass, and polymers. For ferrous metal construction, the ferrous metal may be treated to resist corrosion as the securable delivery container 100 may be exposed to a multitude of environments and inclement weather. In the preferred embodiment, the lid 104 is constructed from a polymer including, but not limited to, polyvinyl chloride (PVC). One skilled in the art may choose other types of material based on the environment that the enclosure 102 will be exposed to. Other factors one skilled in the art may consider are municipal codes, covenants, and aesthetic requirements.

The enclosure 102 may be limited to the size and number of packages that may be delivered. A package may refer to a boxed or a loose item. In the event a package or a series of packages exceeds the capacity of the enclosure 102, a deployable external compartment 106 may be deployed to the exterior of the enclosure 102. The deployable external compartment 106 may be affixed to the proximate end of a security cable 108 and the distal end of the security cable 108 may be removably affixed to the anchor point 502 within the enclosure 102.

The lid 104 is secured to the enclosure 102 to prevent unauthorized access to the receiving compartment 204 by an external lock 110. The external lock 110 may provide access to authorized users to place packages into or retrieve packages from the receiving compartment 204 while preventing unauthorized access to the receiving compartment 204. The securable delivery container 100 is preferably locked by default unless the owner changes the default configuration. This default configuration prevents unauthorized items from being placed inside the receiving compartment 204 and the internal components being compromised or tampered with. The external lock 110 will be furthered described hereinafter.

Figure 2:
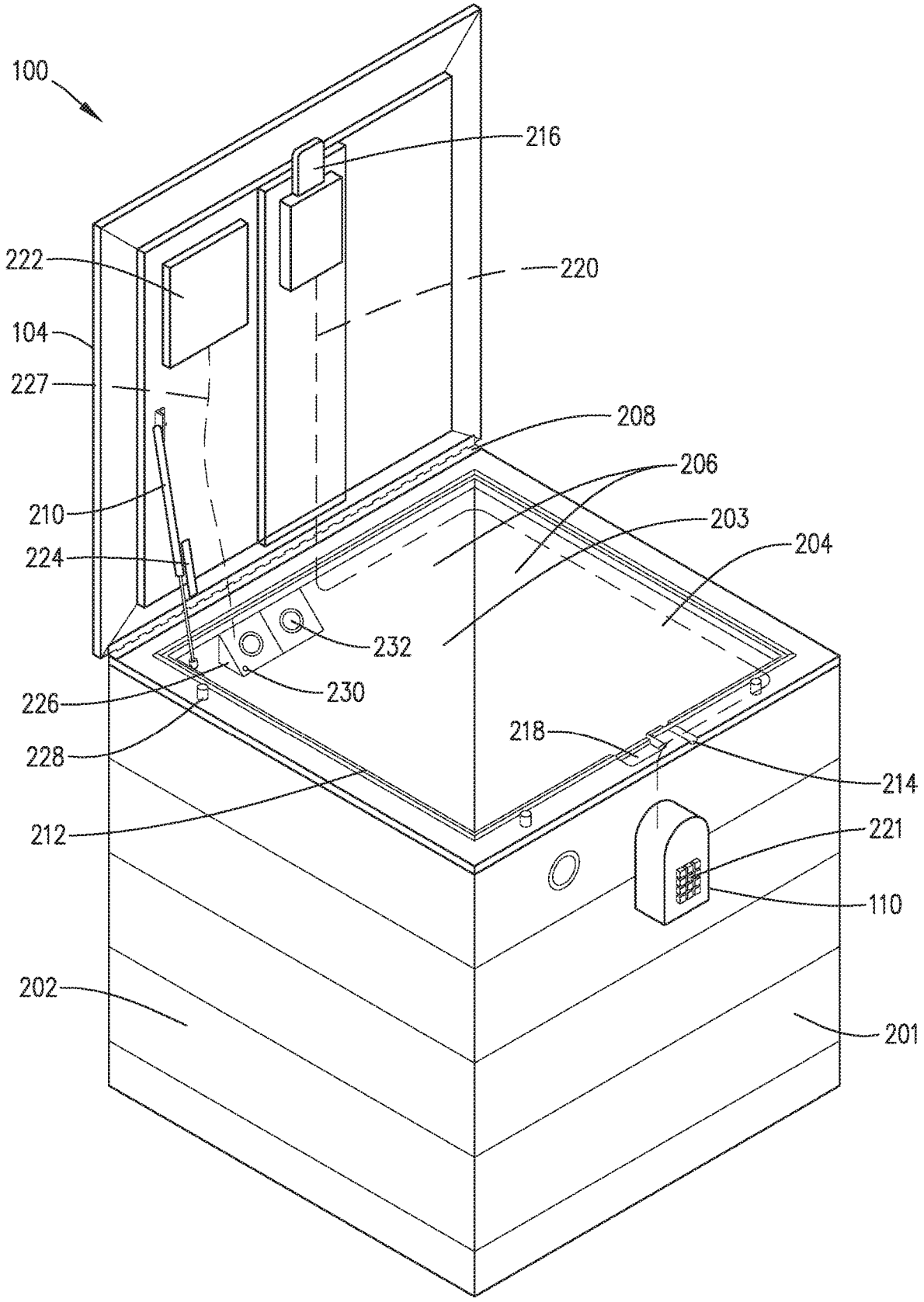
FIG. 2 is a perspective view of an open securable delivery container.

FIG. 2 is a perspective view of an open securable delivery container 100. The enclosure 102 may be comprised of one front wall 201, two parallel sidewalls 202, and one rear wall 203. The front wall 201, two sidewalls 202, rear wall 203 and the bottom 501 (not shown) creating a receiving compartment 204 therein. One skilled in the art may construct the enclosure 102 from materials selected from ferrous and non-ferrous metals, composites, carbon fiber, fiberglass, and plastic polymers. Ferrous metals may be treated for corrosion resistance including, but not limited to, galvanization for enclosures 102 exposed to the environment. Composite materials may include a wood composite and plastic composites. In the preferred embodiment the enclosure 102 is constructed from a PVC. One skilled in the art may choose other types of material based on the environment that the enclosure 102 will be exposed. Other factors one skilled in the art may consider are municipal codes, covenants, and aesthetic requirements.

In the above described embodiment, the receiving compartment 204 does not have temperature control and may be known as a "dry box" for receiving dry goods that do not require cooling or heating. In a preferred embodiment, the receiving compartment 204 may have temperature control that may be either passive or active. Passive temperature control may include, but is not limited to, removably or rigidly affixed insulation 206. The insulation 206 may be affixed to the front wall 201, sidewalls 202, rear wall 203, bottom 501, and the lid 104. The insulation 206 may minimize the effects of the external environment on the receiving compartment 204. Active temperature control 518 will be discussed in FIG. 5.

In the preferred embodiment, the lid 104 is hingedly affixed to the rear wall 203 via a hinge 208 allowing a user to unlock the lid 104 and rotate the lid 104 about the hinge 208 from the horizontal position to the fully open vertical position. A lift support 210 may be used to maintain the lid 104 in the vertical position while delivering and removing packages. The lift support 210 may be used to assist and control the opening and closing of the lid 104. One skilled in the art may choose to use a single lift support 210 or a plurality of lift supports 210 based on the weight of the lid 104 to assist opening, closing, and maintaining the lid 104 in the open position. Additionally, one skilled in the art may select the lift support 210 from a group of mechanical, pneumatic, hydraulic, electromechanical, electrohydraulic and electropneumatic lift supports. Preferably, the lift support 210 for the enclosure 102 is pneumatic.

A drone delivery discussed herein may require the lift support 210 to be selected from electromechanical, electrohydraulic and electropneumatic lift support. The drone 814 may communicate with the securable delivery container 100 to unlock the external lock 110 and the lift support 210 via the system controller 222 to lift the lid 104 into the fully open position. The drone may maneuver over and drop the package into the receiving compartment 204. After the package is dropped into the receiving compartment 204, the drone 814 may maneuver away from the securable delivery container 100 and communicate with the system controller 222 to lower the lid 104 using lift support 210 and to lock the lid 104.

A lid position sensor 224 may be rigidly affixed to a lift support 210 to indicate the position of the lid 104. The lid position sensor 224 may indicate when the lid 104 is in a closed position, an open position or somewhere in between. The lid position sensor 224 may assist the system controller 222 in determining whether there has been unauthorized access or potential tampering by the lid's 104 position. Additionally, the lid position sensor 224 may provide information to the drone 814 to indicate when the lid 104 is in the desired position to receive the package.

The front wall 201, sidewalls 202 and rear wall 203 may be rectangular in shape and one skilled in the art may size the securable delivery container 100 to accept a variety of different sized packages. For residential use, the securable delivery container 100 may be smaller than a securable delivery container 100 for commercial use. Additionally, an apartment complex may have a series of securable delivery containers 100 arranged in a group where the group may share a common front and rear wall. In the preferred embodiment, the securable delivery container 100 is square. The walls 201, 202, 203 may have a thickness to support a seal 212 and cooperative surfaces between the walls 201, 202, 203 and the lid 104. As the lid 104 is moved from the open position to the closed position, the lid 104 engages a seal 212 rigidly affixed to walls 201, 202, and 203, where the lid 104 compresses the seal 212 to prevent environmental loss from the receiving compartment 204.

A cable lock receiver 214 may be positioned in the top of front wall 201 or the sidewalls 202. The cable lock receiver 214 may comprise a semi-cylindrical opening in the top of front wall 201 that extends from receiving compartment 204 through the front wall 201 to the exterior of the securable delivery container 100. The cylindrical opening may be sized to substantially engage the security cable 108 and prevent cable stops 302 from passing through the cable lock 214. The seal 212 may follow the curvature of the cable lock receiver 214, where the security cable 108 may engage the top of the seal 212 and the lid 104 to minimize environmental losses. An alternative embodiment allows for the seal 212 ends to overlap at the cable lock 214 such that the security cable 108 may traverse between the seals 212 end to engage the cable lock 214. Preferably, the seal 212 is cut at the cable lock 214 allowing the security cable 108 to traverse the seal 212 and be positioned under the seal 212 where the security cable 108 engages the cable lock 214. The cable lock 214 will be described further in FIG. 5.

The video capture system may comprise a camera 226, camera wiring 227 and a camera sensor 228. Preferably, the camera 226 is mounted to the rear wall 203 and angled sufficiently to capture an image of an individual placing a package into or removing a package from the receiving compartment 204. Once a person has sufficiently lifted the lid 104 to trigger camera sensor 228, the camera sensor 228 may communicate directly with the camera 226 or indirectly with the camera 226 through the system controller 222 through camera wiring 227 to capture an image of the person placing or removing the package. One skilled in the art may use a variety of sensor types including but not limited to contact sensors to sense the lid 104 being opened and provide sufficient time to capture a detailed image of the person placing or removing the package. The camera 226 may store the images locally on memory or on removable memory cards. Additionally, the camera 226 may transmit the data to a remote data storage device and may also send the images to the owner via the system controller 222 through a communication method including but not limited to a text message, an email, pre-recorded message, and notification applications. The images may be selected from video and pictures.

A system controller 222 may be utilized to control the securable delivery container's 100 different functions described hereinafter. The system controller 222 may be mounted on the interior of the securable delivery container 100. Preferably, the system controller 222 is removably affixed to the lid 104 for easy access. One skilled in the art may select other positions to mount the system controller 222 within the receiving compartment 204. However, by affixing the system controller 222 to one of the walls 201, 202, 203, the space available for packages may be reduced. The system controller 222 will be described in further detail in FIG. 4.

The external lock system may comprise a lock striker 216, a lock latch 218, lock wiring 220, and the external lock 110 with an external keypad 221. In the preferred embodiment, the lock striker 216 is mounted on the lid 104 and electrically communicates with the external lock 110, the lock latch 218 is rigidly affixed to the top and interior of the front wall 201, and the external lock 110 with the keypad 221 is mounted on the front wall 201. In an alternate embodiment, the external lock system may be reduced to a two-piece system, having a lock latch 218 and remaining components the lock striker 216, lock wiring 220, and external lock 110 with the keypad 221 combined into a single unit.

The external lock 110 may be selected from an electronic lock. The electronic lock may be selected from a digital lock, a proximity lock, a remote lock, a scan lock and a biometric lock. In the preferred embodiment, an external lock 110 is a digital lock used to secure the lid 104 to the enclosure 102 to prevent unauthorized access. In alternate embodiments, the external lock 110 may wirelessly communicate with a communication device 806 to lock and unlock the securable delivery container 100. One skilled in the art may select the wireless communication from a group of Wi-Fi™, Bluetooth™, infrared, mobile cellular communications, and near field communications. Additionally, a drone 814 being used to deliver packages may also communicate wirelessly with the delivery container 100 to unlock and open the delivery container 100 and to close and lock the deliver container 100. The external lock 110 may be opened using a combination of alphanumeric characters, special characters, symbols, and Braille. One skilled in the art may choose keyboard lighting selected from backlighting, individual lighted keys on the keypad, and keypad area lighting. The external lock 110 may also encounter various environmental conditions depending on the placement of the delivery container 100. Preferably, the delivery container's 100 external lock 110 is weather resistant to address environmental conditions including, but not limited to, temperature and moisture.

A user unlocking the delivery container 100 may enter a security code into the external lock 110 via the keypad 221. If the security code entered by the user matches the stored security code, then the external lock 110 may send a signal through the lock wiring 220 to the lock striker 216 to retract from the lock latch 218 allowing the lid 104 to be opened. The external lock 110 may detect tampering by monitoring the number of unsuccessful security code input attempts within a specific amount of time. If the number attempts is exceeded, then the external lock 110 may be locked out and prevent the external lock 110 from being opened for a period of time as determined by one skilled in the art or owner. Additionally, the external lock 110 may also detect a physical attempt to pry open the delivery container 100. If the external lock 110 detects tampering, the owner may be alerted via a communication device 806 by methods including, but limited to, text, email, a prerecorded voice mail message and a notification application. The lock 110 may use the communication paths described below in FIG. 8 to alert the owner.

Figure 3:
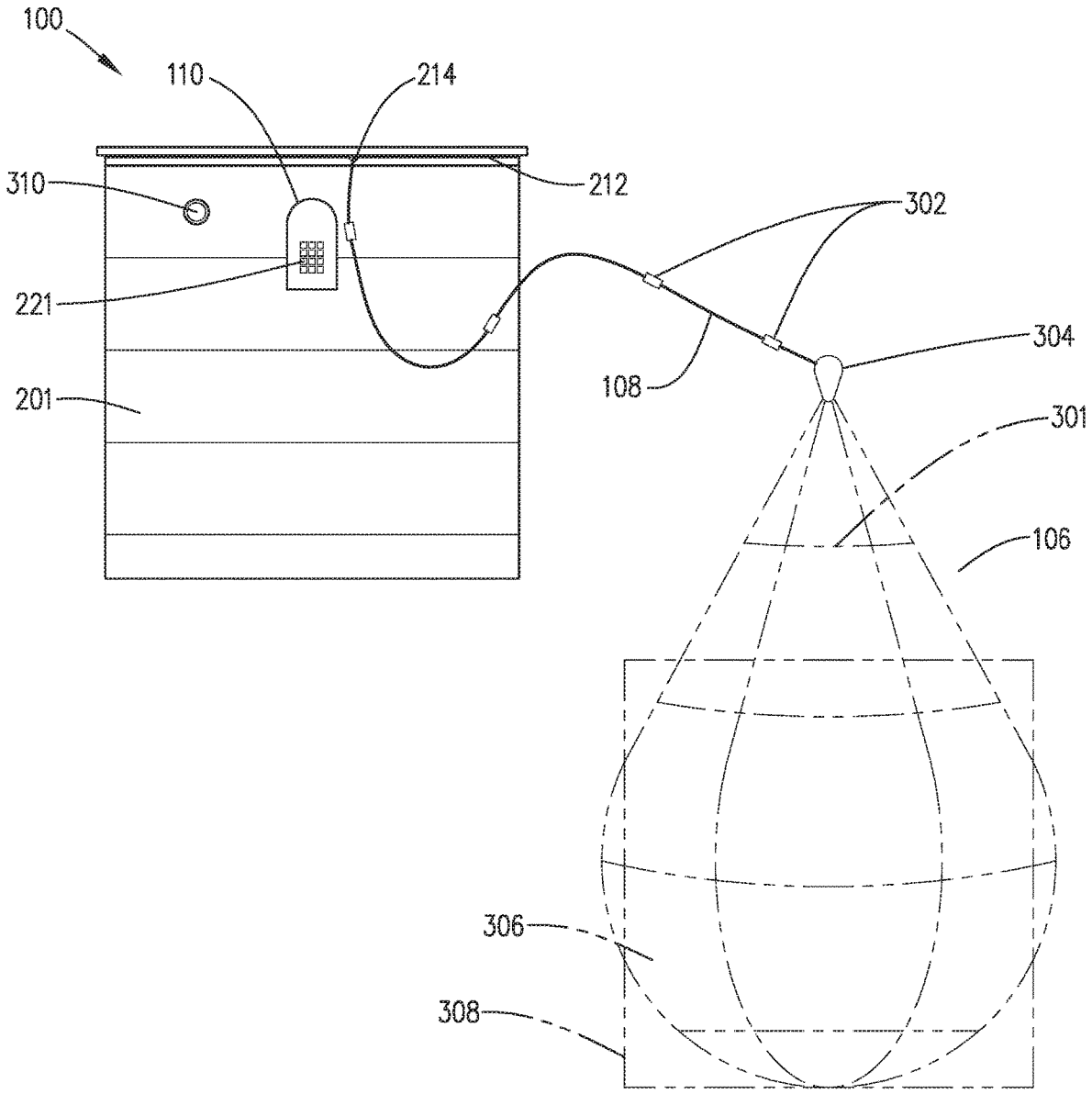
FIG. 3 is a front view of a closed securable delivery container with external compartment deployed.

FIG. 3 is a view of a closed securable delivery container front 100. An ambient air temperature sensor 310 may be rigidly affixed to the exterior of a wall of the securable delivery container 100. The ambient air temperature sensor 310 provides the current outside temperature of the securable delivery container 100 to the system controller 222 and to the owner. One skilled in the art may determine the placement of the ambient air temperature sensor 310 to minimize erroneous readings caused by the surroundings. Preferably, the ambient air temperature sensor 310 is placed near the top of a wall to lessen the effects of the supporting surface which may include, but is not limited to, concrete and asphalt.

Also illustrated in this view, the seal 212 that is rigidly affixed to the top of the front wall 201, sidewalls 202 and rear wall 203 is compressed by the lid 104 to maintain the internal environment of the securable delivery container 100.

The deployable external compartment 106 may comprise a security cable 108 with a plurality of cable stops 302, a plurality of compartment cinch loops 304, receiving material 301, and an external receiving compartment 306 defined therein. The receiving material 301 may be a constructed from a mesh and solid material. This application incorporates by reference a deployable external compartment of the type disclosed in U.S. Pat. Nos. 3,756,300, 5,050,999 and 360 eXomesh® locking from Pacsafe® (pacsafe.com/Explore-Technology). Preferably, a wire mesh is the receiving material 301 utilized to create the deployable external compartment 106. A plurality of compartment cinch loops 304 may be attached to the perimeter of the receiving material 301. The security cable 108 may be inserted through the compartment cinch loops 304. As the security cable 108 is drawn through the compartment cinch loops 304, the compartment cinch loops 304 are moved closer together creating the receiving compartment 306 in the receiving material 301 to receive an oversized package 308. Once the oversized package 308 is placed in the external receiving compartment 306, the security cable 108 is drawn until the deployable external compartment 106 substantially encapsulates the oversized package 308 and the opening between the compartment cinch loops 304 is sized to prevent the oversized package 308 from being removed from the deployable external compartment 106. A user may utilize the deployable external compartment 106 by disconnecting and removing the quick-disconnect 506 from the receiving compartment 204 and extending the deployable external compartment 106 outside the securable delivery container 100. Once the deployable external compartment 106 is removed, the user may separate the compartment cinch loops 304 on the security cable 108 to create an opening to receive the oversized package 308. The user then places the oversized package 308 in external receiving compartment 306 within the deployable external compartment 106. The quick-disconnect 506 is reattached to the anchor point 502. The security cable 108 is drawn through the compartment cinch loops 304 to reduce the size of the opening to prevent the oversized package 308 from being removed from the deployable external compartment 106. Once the security cable 108 has been drawn sufficiently to minimize the size of the opening, then the security cable 108 may be placed in the cable lock 214 with cable stop 302 to engage the interior portion of the cable lock 214 of the securable delivery container 100. The cable stop 302 may prevent the security cable 108 from being drawn sufficiently to the exterior of securable delivery container 100 to prevent the oversized package 308 from being removed from the deployable external compartment 106.

Alternatively, one skilled in the art may use a friction lock in lieu of the cable stops 302 in conjunction with the cable lock 214 of the securable delivery container 100 to secure the deployable external compartment 106. The security cable 108 after having been drawn sufficiently to minimize the size of the opening of the deployable external compartment 106, the security cable 108 may be inserted into the friction lock to a desired depth to maintain the size of the opening of deployable external compartment 106. The friction lock may be positioned to engage the interior portion of the cable lock 214 of the securable delivery container 100. The friction lock may prevent the security cable 108 from being drawn sufficiently to the exterior of securable delivery container 100 to allow the oversized package 308 to be removed from the deployable external compartment 106. the security cable 108 was drawn sufficiently to the exterior of securable delivery container 100, the friction lock may still prevent the package from being removed from deployable external compartment 106. The friction lock may be mechanical and electronic.

Figure 4:
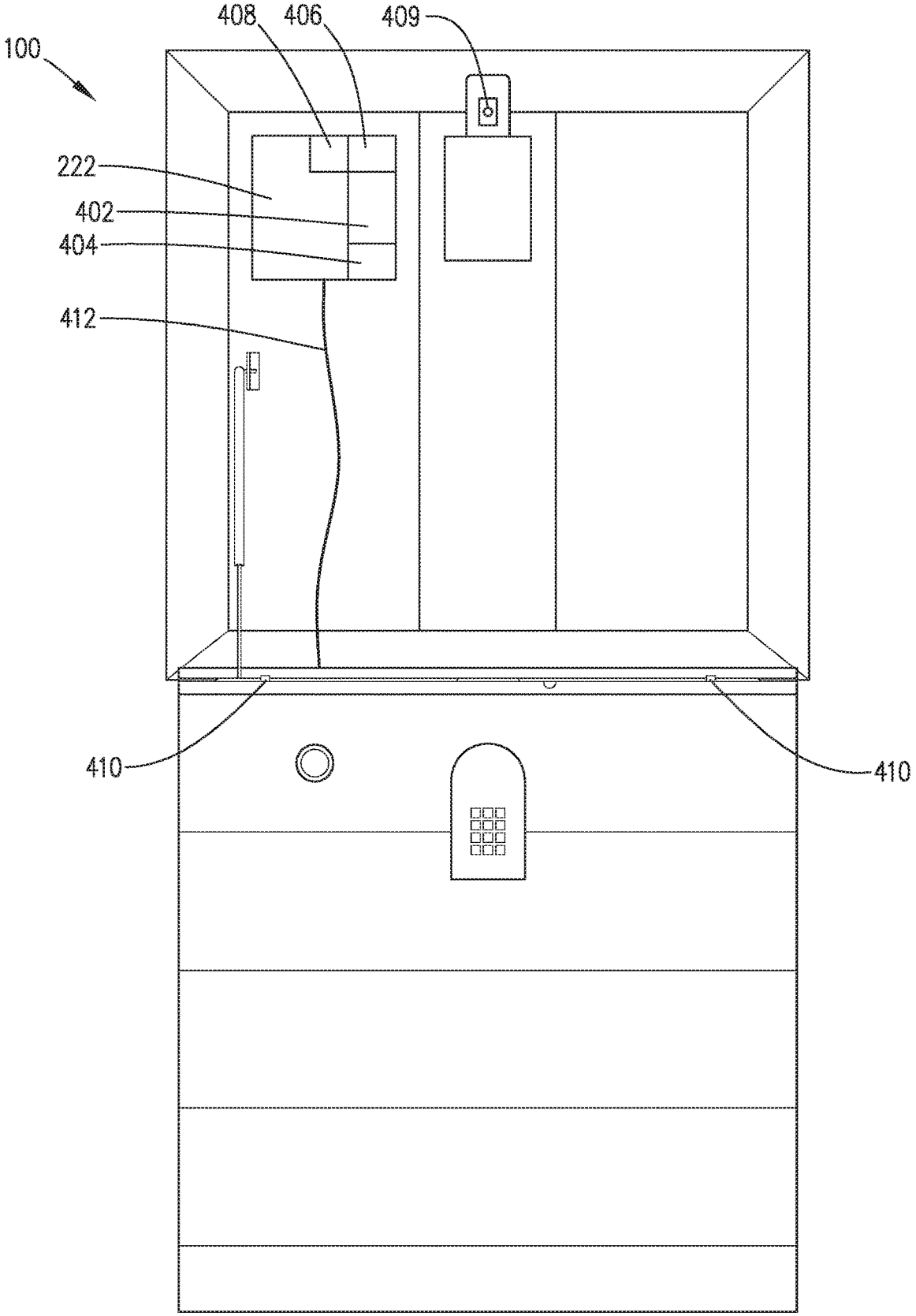
FIG. 4 is a front view of an open securable delivery container without external compartment deployed.

FIG. 4 is a view of an open securable delivery container front 100. This view illustrates the system controller 222, an entry sensor 410, and the system controller wiring 412. The system controller 222 may comprise a communication section 402, a power section 404, a storage section 406 and a temperature control section 408. One skilled in the art may select a system controller 222 from a group comprising of analog components, a microprocessor, a microcontroller and a programmable logic controller. The system controller 222 may monitor the overall system operations and communicate with system components via the system controller wiring 412.

The system controller 222 may detect package placement into and package removal from the receiving compartment 204. The system controller 222 may be programmed by the system controller interface 704 on the lid 104 and remotely through including, but not limited to, a communication device 806 with a user application. This allows an owner to program parameters of the securable delivery container 100, including, but not limited to, the security code and the temperature controls.

The communication section 402 of the system controller 222 may provide internal communications within the securable delivery container 100 and externally with other devices including, but not limited to, communication devices 806. The communication section 402 receives and transmits data and control signals to other components within the securable delivery container 100 that may set the temperature, timing, and alarms. For example, upon the lid 104 being sufficiently opened to trigger the entry sensors 410, the sensors 410 may notify the system controller 222 through the communication section 402 of the entry. A system controller 222 may determine whether the entry into the securable delivery container 100 was authorized or not based on whether a matching security code was entered or scanned. If the entry was unauthorized, the system controller 222 may notify the owner through the communication section 402 and the communication device 806 that there has been an unauthorized entry. That communication device 806 may provide an audio and visual notification to the owner. The owner may determine whether the audio alarm 708 and visual alarm 710 should be activated. Additionally, if the securable delivery container 100 determines that the entry is unauthorized and receives no response from the owner via the communication device 806 within a predetermined time limit, then the system controller 222 may activate the alarms 708 and 710.

The communication section 402 of the system controller 222 may communicate externally with communication devices 806 via wired and wireless communications. The communication section 402 of the system controller 222 may transmit and receive data through a wired connection that may allow an owner to transmit security codes and temperature control information and receive image data residing in the storage section 406. Additionally, the wired communication may allow other programming and maintenance functions. The securable delivery container 100 may be directly wired to a local area network.

The communications section 402 of the system controller 222 may also communicate externally through a wireless connection to provide data and control information. Wireless communication may be selected from Wi-Fi™, Bluetooth™, infrared, mobile cellular communications, and near-field communications. One skilled in the art may also connect the system controller 222 to wireless networks via the communication section 402 including, but not limited to, local area networks, a wide-area networks, wireless hotspots, and broadband cellular networks. These connections may enable the owner to communicate with securable delivery container 100 and vice versa using a communication device 806. The communication device 806 may be selected from a desktop, laptop, smart phone, tablet, smart watch, scanner, delivery tracker, key fob, drone, and a proximity card. Within the communication devices 806, a few of the devices can only lock and unlock the securable delivery container 100 including, but not limited to, scanner, delivery tracker, key fob, drone, and a proximity card.

The communication section 402 may be able to interface with the owner's building security system to provide notifications and alarms. If the building security system is monitored, then the system controller 222 may notify the monitoring service of an unauthorized access to the securable delivery container 100.

The owner may be able to communicate with a user that has opened the securable delivery container 100 once the camera 226 has been activated through the speaker 232 and receive response communication from the user via the microphone 230 near the camera 226.

The power section 404 may monitor and control the power distribution and storage. The power section 404 may provide power to: the system controller 222; the system controller interface 704; sensors 224, 228, 310, 410, 512, 514, and 602; the external lock 110; the scanner 706; alarms 708 and 710; and the active temperature control 518. The securable delivery container 100 and system controller 222 may receive its power from direct current (DC) and alternating current (AC). The DC power source may be a battery, which may be rechargeable. The battery may be recharged by AC power from an AC power chord 522 or recharged by solar panels 702. The power section 404 may monitor the battery and provide notification of the status of the battery such as the remaining charge to the owner through a communication device 806.

The storage section 406 of the system controller 222 may store data locally in fixed memory or in a removable media such as secure digital memory card. Other types of removable media known to one skilled in the art may be used to store data. The data may include, but is not limited to, image data and system data. If the data is stored locally then a communication device 806 may access the stored data via the communication section 402 of the system controller 222. The locally stored data may be transferred to the communication device 806 by the communication section 402 of the system controller 222. The storage section 406 of the system controller 222 may store data remotely using an external storage device. The storage section 406 may store the data locally and transmit the data via the communication section 402 under the control of the system controller 222 to an external storage device including, but not limited to, an external hard drive, server or the Cloud. Additionally, the data such as delivery time and images may be timestamped to indicate when specific events occurred.

The temperature control section 408 may regulate the internal temperature of a receiving compartment 204 or temperature-controlled area 610. The temperature control section 408 may communicate with the active temperature control 518 to cool or heat the receiving compartment 204 or temperature-controlled area 610 to a desired temperature.

Additionally, the owner may set a desired temperature and the time for a desired temperature based on information from the temperature sensors 310 and 514. The system controller 222 may calculate the amount of time needed to reach the desired temperature and determine the current time. The system controller 222 may then calculate the time when to communicate with the temperature control section 408 to program the temperature to achieve the desired temperature by a desired time. The system controller 222 may actively control this process through the temperature control section 408 and active temperature control 518 as required, based on changing conditions such as the outside temperature. Additionally, the temperature control section 408 may record the receiving compartment 204 or temperature-controlled area 610.

An internal lock release 409, allows for the securable delivery container 100 to be opened from the inside. This release allows a child to escape the securable delivery container 100 if they were to become trapped in locked securable delivery container 100.

Figure 5:
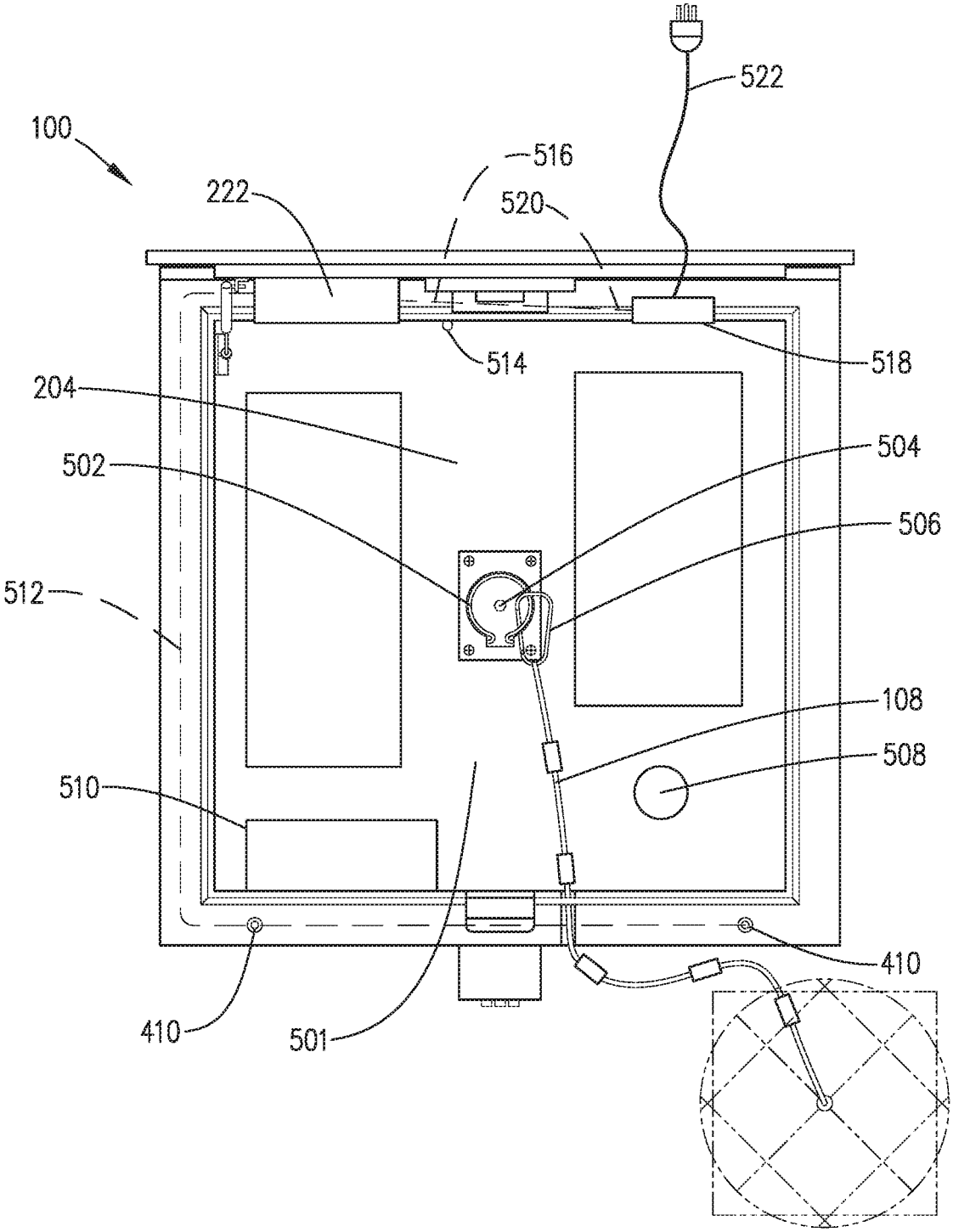
FIG. 5 is an inside view of an open securable delivery container receiving compartment with external compartment deployed.
Figure 5:
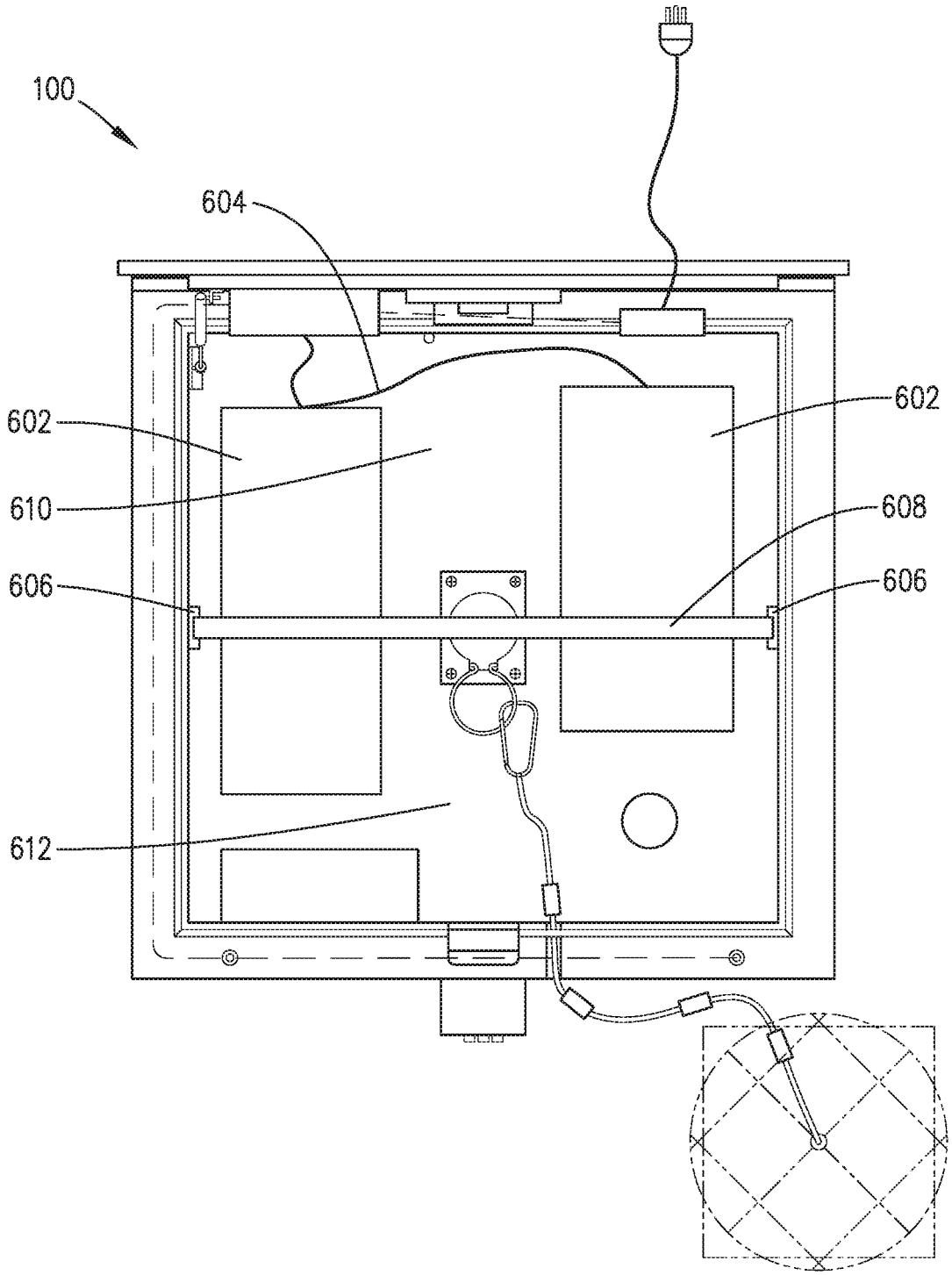

FIG. 5 is a view of the securable delivery container interior 500. The interior may comprise a bottom 501 and a money compartment 510. The bottom 501 may further comprise an anchor point 502, an anchor fastener 504, and a washout plug 508. The bottom 501 may be rigidly affixed to the walls 201, 202, and 203 creating the receiving compartment 204 therein. An anchor point 502 may be rigidly affixed to the bottom 501 of the enclosure 102. In the preferred embodiment, an anchor fastener 504 may extend through the bottom 501 and anchor point 502 and engage an exterior surface below including, but not limited to, concrete to provide a rigid attachment point. Preferably, a concrete fastener is used to secure the securable delivery container 100 to the concrete surface to prevent the securable delivery container 100 from being removed. In the preferred embodiment, the anchor point 502 is located in the center of the bottom 501. One skilled in the art may select a different location within receiving compartment 204 to place the anchor point 502. In an alternate embodiment, at least one anchor point 502 may be placed on a wall 201, 202, and 203 for attachment to vertical surfaces where the securable delivery container 100 may be rigidly affixed to a fence. For ease of removing the oversized package 308 from the deployable external compartment 106, a quick disconnect 506 may be removably affixed to the distal end of the security cable 108 where the quick disconnect 506 is then removably affixed to the anchor point 502. In the preferred embodiment, the quick disconnect 506 is a carabiner but other quick disconnect methods and devices known to one skilled in the art may be used to affix the deployable external compartment 106 to the securable delivery container 100. Preferably, an owner upon receiving an oversized package 308, may disconnect the carabiner from the anchor point 502 and remove the security cable 108 allowing the deployable external compartment 106 to be removed from the securable delivery container 100 where the oversized package 308 is more easily removed.

While many of the deliveries are typically solids, some deliveries may include liquids and these liquids may leak while waiting for retrieval by the owner. A washout plug 508 covers an opening in the bottom 501 where the opening fluidly connects the receiving compartment 204 to the exterior of the securable delivery container 100. A washout plug 508 may be removed to allow the owner to clean the receiving compartment 204 by washing the receiving compartment 204 and allowing the spilled liquid and cleaning solution to exit the receiving compartment 204 through the opening. The washout plug 508 may prevent the intrusion of the environment including, but not limited to, insects, debris, and moisture.

A money compartment 510 may be rigidly affixed to the receiving compartment 204. The money compartment 510 may allow an owner to purchase items that require cash on delivery. The owner may place the correct amount of money into the money compartment 510 where the user may then apply the appropriate security code to open the securable delivery container 100, place the delivery inside the receiving compartment 204, and then remove the cash from the money compartment 510.

The entry sensor wiring 512, electrically connects the entry sensors 410, that may be located on the top of the front wall 201 to the system controller 222. Upon the lid 104 being sufficiently displaced from the top of the front wall 201, the sensors 410 may detect the intrusion and notify the system controller 222 that lid 104 has been displaced from the locked position on the securable delivery container 100.

The securable delivery container 100 may be powered with direct current (DC) or alternating current (AC). A battery may provide DC power for the securable delivery container 100. Additionally, the securable delivery container 100 may receive AC power from an AC power chord 522 extending from the rear wall 203 of the securable delivery container 100. The AC power may be used to recharge a battery. The AC power chord 522 may receive the standard 120 VAC for United States owners but one skilled in the art may configure the securable delivery container 100 to accept other AC power sources such as 230 VAC in European countries. The AC power chord 522 VAC may be connected to standard household sockets that provides 120 volts VAC.

The receiving compartment 204 may be temperature controlled. The receiving compartment 204 may be heated or cooled to a desired temperature depending on the type of delivery that may be received. For example, if the delivery was a pizza, the receiving compartment 204 may be heated to a desired temperature to maintain the desired temperature of the pizza until the owner was able to be retrieve the pizza. Additionally, the owner may desire to receive refrigerated items. The receiving compartment 204 may be cooled to accept and maintain refrigerated items at a desired temperature to prevent spoilage. An interior temperature sensor 514 may sample the temperature in the receiving compartment 204 and provide the information to the system controller 222 via the interior temperature sensor wiring 516. If the temperature in the receiving compartment 204 requires adjusting to prepare for the receipt of a temperature sensitive delivery and maintaining the temperature, the system controller 222 may receive the current temperature of the receiving compartment 204 compare the temperature to the desired owner setting and may communicate with the active temperature control 518 through the active temperature control wiring 520 to increase or decrease the receiving compartment 204 temperature to achieve the desired temperature for the delivery. Once the desired temperature is achieved or exceeded, the owner may be notified of the status. The owner may through the communication device 806 communicate remotely with securable delivery container 100 to set a desired temperature for the receiving compartment 204 to maintain. Additionally, for efficiency and energy savings, the owner may set a desired time of delivery with a desired temperature that is required at delivery. The system controller 222 may delay changing the temperature of the receiving compartment 204 until the delivery time approaches, then the system controller 222 may communicate with the active temperature control 518 to modify the temperature of the receiving compartment 204 to reach the desired temperature by the expected delivery time.

FIG. 6 illustrates the divided securable delivery container 600. A divided securable delivery container 600 may comprise the receiving compartment 204 with two divider holders 606 and an insulated divider 608. The embodiment illustrates the receiving compartment 204 being divided into a temperature-controlled area 610 and a non-temperature-controlled area 612. An insulated divider 608 may be placed into divider holders 606 to create two separate areas for receiving deliveries. One skilled in the art may add additional divider holders 606 to create different sized divided sections. In this embodiment, the front area may be a non-temperature-controlled area 612 and the rear area may be the temperature-controlled area 610. The divided container 600 may allow for mixed types of deliveries. Utilizing the insulated divider 608, may reduce the size of packages that may be deliverable to divided securable delivery container 600, however, the deployable external compartment 106 may compensate for this loss of space.

The securable delivery container 100 may detect the delivery of packages by a user. A delivery sensor 602 may electrically communicate with the system controller 222 via delivery sensor wiring 604. When a package is placed within the receiving compartment 204 of the securable delivery container 100, the delivery sensor 602 including, but not limited to, a contact sensor and pressure sensor detects the placement of the package and notifies the system controller 222, which then may notify the owner that a package has been placed inside the securable delivery container 100. If the package is removed, the owner may be notified of the removal. If the package removal is unauthorized, the audio alarm 708 and visual alarm 710 may be activated.

Figure 7:
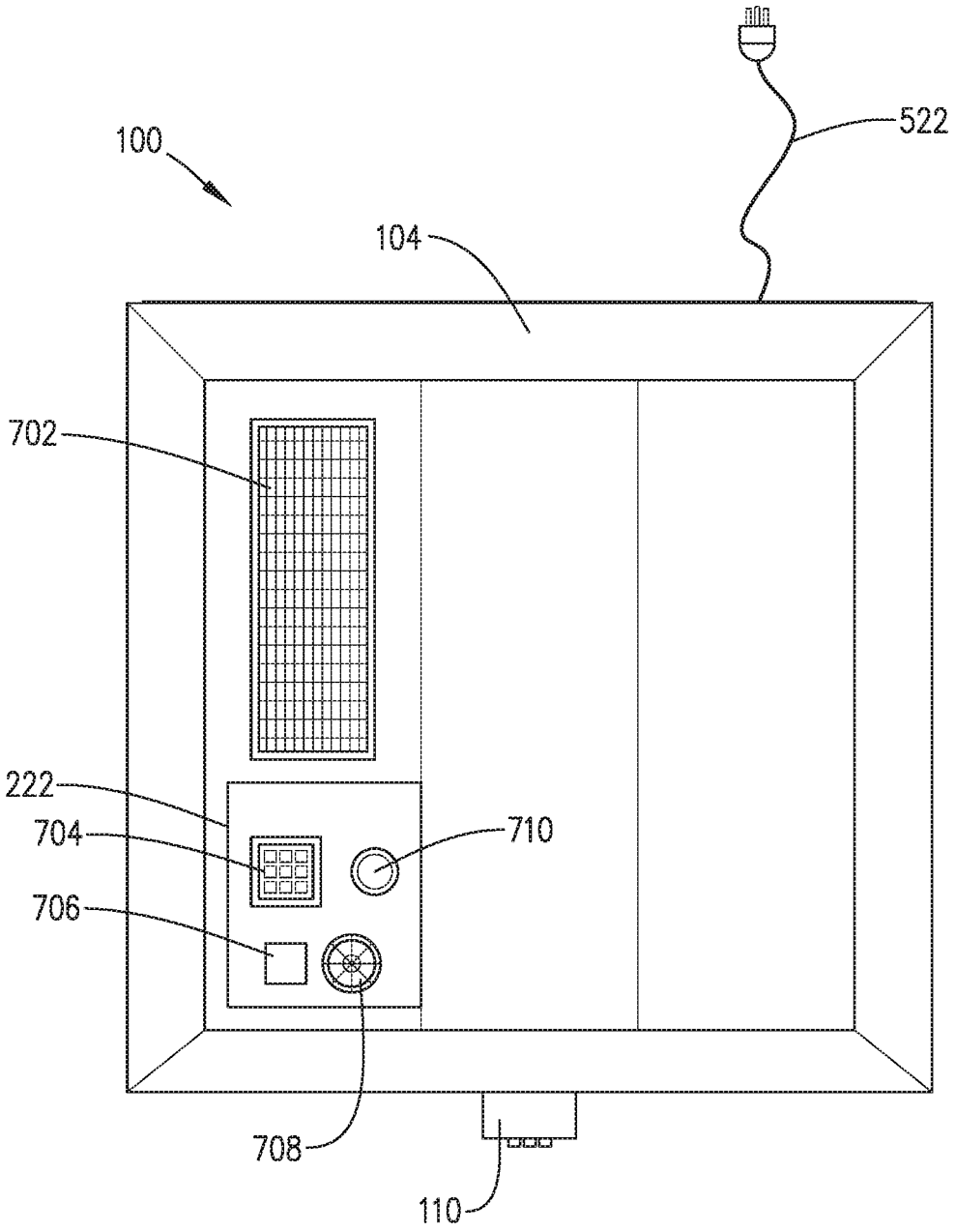
FIG. 7 is a top view of a lid for the closed securable delivery container receiving compartment with external compartment deployed.

FIG. 7 is a view of the lid top 700. The lid top 700 may comprise solar panel 702, a system controller interface 704, a scanner 706, an audio alarm 708, and a visual alarm 710 and notification 710. The solar panel 702 may consist of a plurality of solar panels electrically connected to charge DC power source, such as a battery described earlier.

The system controller interface 704 may comprise a display and input section that may allow the owner to view the inputs as they program the system controller 222 parameters including, but not limited to, time, security codes that allow entry, and temperature. The system controller interface 704 may also allow the owner to view the status and monitor operations of the securable delivery container 100. The security codes may be selected from a group of temporary codes, static codes, and dynamic codes. The temporary codes allow a security code to set for a specific time range. The owner sets a security code for a specific window of time for the delivery. If the delivery occurs within this window, then the user will be able to unlock the securable delivery container 100. However, if the user attempts to deliver outside the window, then the security code will not unlock the securable delivery container 100 and may require owner intervention. A static code is security code that once programmed does not change without owner intervention such as deleting or changing the security code. A dynamic code is one that is constantly changing based on some selected parameter or parameters. For example, a dynamic code may consist of a dynamic portion and a static portion where the static portion remains constant until changed and the dynamic portion may be based on parameters such as the date.

A scanner 706 may be used to unlock the securable delivery container 100. The scanner 706 may scan biometrics including, but not limited to, a fingerprint to authorize access and unlock the securable delivery container 100. The scanner 706 may also be able to scan a universal product code (UPC) and quick response code (QRC) where the security code may be embedded within the UPC or QRC to unlock the securable delivery container 100. Alternatively, the UPC and QRC that are produced by a delivery service may be programmed into the system controller 222 via the scanner 706 or a communication device 806. A user may deliver a package to the securable delivery container 100 and place the UPC and QRC over the scanner 706 where the scanner 706 compares the code on the package with the code stored in the system controller's 222 memory. If the codes match, the securable delivery container 100 unlocks for the user to place the package in the securable delivery container 100. The securable delivery container 100 may report to the owner that a delivery has been made.

As described earlier, entry sensors 410 may detect when the lid 104 is opened sufficiently to indicate a breach and notify the system controller 222 of the breach. The system controller 222 may determine if the breach is an authorized and if unauthorized, notify the owner via communication device 806. Additionally, an unauthorized entry into the securable delivery container 100 may activate an audio alarm 708 and a visual alarm 710 including, but not limited to, flashing lights. For example, upon an unauthorized entry into the securable delivery container 100 or number of unsuccessful security code attempts, an audio alarm 708 and a visual alarm 710 may activate to warn off the unauthorized person and prevent the theft of the package. If the owner receives notification of an unauthorized entry, the owner may also activate the alarms 708 and 710 remotely through a communication device 806 or prevent the alarms from being activated so the owner may notify the police. Also, the owner may deactivate the alarms 708 and 710 through the communication device 806. The visual alarm 710 may be utilized to provide notification to the owner that a package has been placed into the securable delivery container 100.

Figure 8:
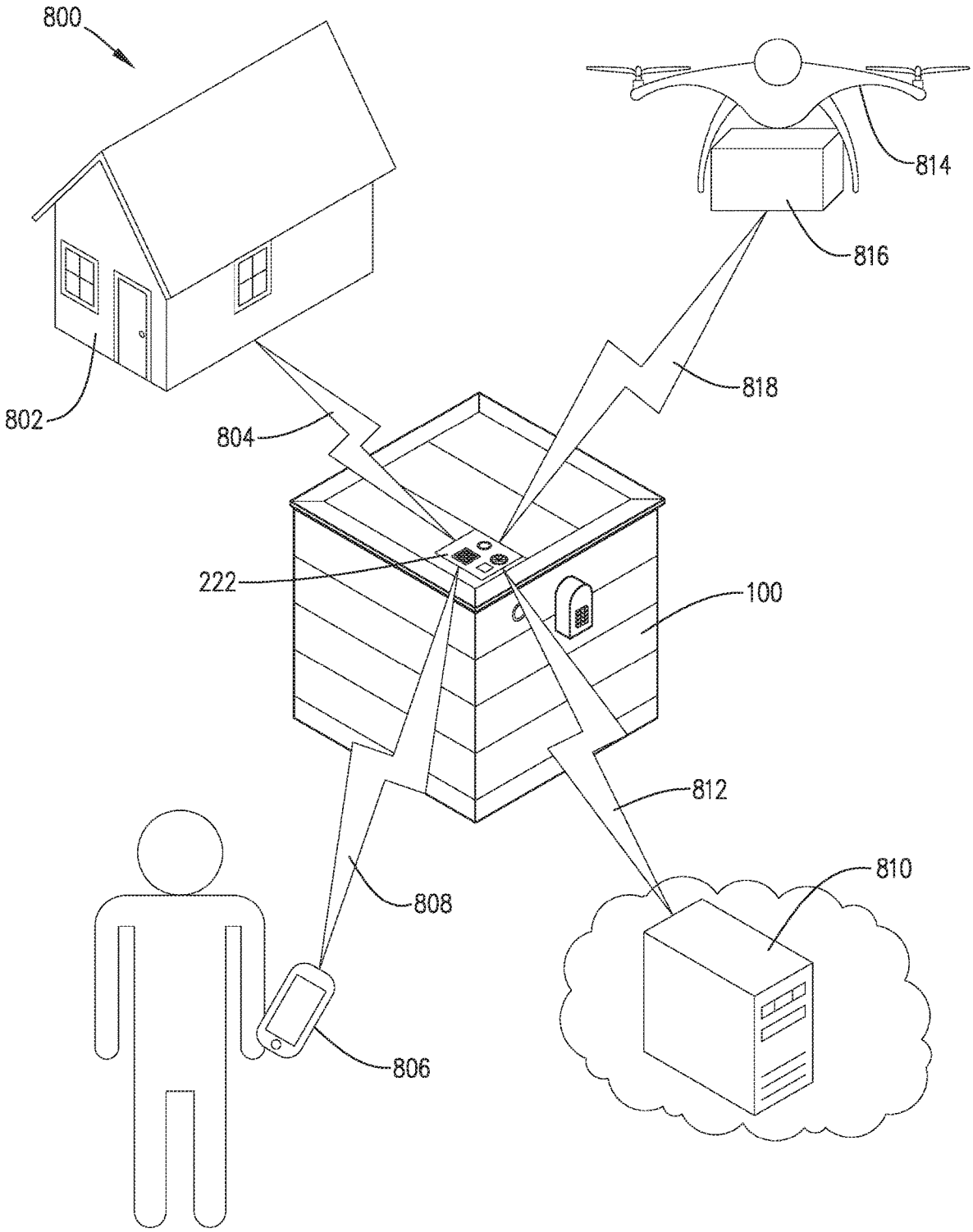
FIG. 8 is a diagrammatic representation of communication networks to interface with the delivery container.

FIG. 8 is a diagrammatic representation of the communication network 800 to interface with the securable delivery container 100. The representation illustrates multiple methods to communicate with and remotely unlock the securable delivery container 100. Illustrated are four methods for unlocking the securable delivery container 100. The first method illustrates an owner remotely communicating with the securable delivery container 100 while they remain secure within their home 802 as a package is being delivered. The owner is notified of the impending delivery and upon identification of the user, the owner while securely inside the home 802 may communicate with the securable delivery container 100 utilizing the Wi-Fi™ communication path 804 and the communication device 806. The owner may transmit the unlocking code through Wi-Fi™ communication path 804 to unlock the securable delivery container 100, where the delivery person places the package within the securable delivery container 100 and departs the owner's location. After the package is placed in the receiving compartment 204, the lid 104 is closed and the owner may transmit a security code to lock the securable delivery container 100.

A second method of communicating and unlocking the securable delivery container 100 may include the owner using a communication device 806 in the proximate location of the securable delivery container 100. The owner through communication device 806 may communicate with the securable delivery container 100 through a multitude of radio frequency (RF) communication paths, including but not limited to, Wi-Fi™, Bluetooth™, and mobile cellular communications. An owner may within the chosen RF distance limits send a security code from the communication device 806 through the radio frequency communication path 808 to unlock the securable delivery container 100. The owner approaches the securable delivery container 100, retrieves the package, closes and locks the securable delivery container 100. Additionally, the owner may remotely open the securable delivery container 100 using a communication device 806. In the preferred embodiment, a communication device 806 application enables the owner to transmit the security code and opening and closing instructions to the securable delivery container 100. Geofencing may also be used to determine when the owner and their selected communication device 806 is within a pre-defined location or geographic area, wherein the communication device 806 automatically unlocks and opens the securable delivery container 100 to provide quick access to the package.

A third method of communicating and unlocking opening the securable delivery container 100 may include the owner remotely communicating with the securable delivery container 100 through the internet 810. An owner upon notification from the delivery service may communicate with the securable delivery container 100 through the internet 810 and the internet communication path 812 to unlock the securable delivery container 100 for the user to deliver the package. The user may open the lid 104, place the package inside the receiving compartment 204 and close the lid 104. The system controller 222 may notify the owner of the opening and subsequent closing of the lid 104, where the owner may through the internet communication path 812 lock the securable delivery container 100 after the delivery.

A fourth method of communicating and unlocking the securable delivery container 100 may include a drone 814. Drone delivery may be in its infancy. One method of drone delivery is the drone 814 releasably transports a package to the desired location from the pick-up point, reduces its altitude in preparation for release to prevent breakage upon the package landing, and releases the package to descend and land at the desired location. Currently, the desired location may be a porch, sidewalk, driveway and a backyard. Drone delivery may present the same problems as ground delivery such as security and protection from the environment. In this embodiment, the drone 814 may depart the pick-up location with a drone package 816 releasably attached. The drone 814 may approach the securable delivery container 100, communicate with the securable delivery container 100 via drone communication path 818, where the drone 814 may supply the security code to unlock the securable delivery container 100, and a subsequent instruction communicated to the securable delivery container 100 from the drone 814 to open the lid 104. The drone 814 may then maneuver in position above the receiving compartment 204 in the securable delivery container 100 after the lid 104 has been opened and release the drone package 816 which descends into receiving compartment 204 inside the securable delivery container 100. After the drone package 816 has been placed inside the receiving compartment 204, the drone 814 may maneuver away from the securable delivery container 100 then communicate with the securable delivery container 100 indicating that the drone package 816 has been delivered and providing instructions to close and lock the lid 104.

Having thus described the invention, I claim:

1. A securable delivery container for storing deliveries and limiting access comprising:

a. at least one delivery container having— i. bottom, ii. a plurality of sidewalls, iii. at least one receiving compartment defined therein, iv. at least one lid attachment, v. at least one lid for accessing the compartment openly affixed to a wall covering the receiving compartment preventing access to the compartment, and vi. at least one compartment anchor point for securing a deployable external compartment;

b. at least one temperature-controlled compartment;

c. at least one external lock; and d. at least one deployable external compartment having— i. at least one flexible sidewall, ii. at least one receiving compartment defined therein, and iii. at least one lock, whereby a delivery person unlocks the delivery container, places a package including temperature controlled packages such as frozen or heated food inside the container and locks the container unless the package is too large or an odd shape that will not fit in the delivery container, then delivery person deploys the external compartment and places the odd package inside the external compartment and secures the odd package to delivery container, closes the lid, and locks the delivery container.

2. The apparatus of claim 1, where the container is constructed of a material selected from ferrous and non-ferrous metal, composites, carbon fiber, fiberglass, wood, and polymers.

3. The apparatus of claim 2, where the ferrous metal may be treated to resist corrosion.

4. The apparatus of claim 2, where the composite is a wood composite and plastic composite.

5. The apparatus of claim 1, where the receiving compartment has a money compartment.

6. The apparatus of claim 1, where the receiving compartment can detect a delivery and removal of the delivery from the compartment.

7. The apparatus of claim 1, where the lid is attached hingedly, slidedly, and rollably to the container.

8. The apparatus of claim 1, where the lid has at least one lift support to assist in the opening of and maintaining the open position, the lift support selected from a group of mechanical, pneumatic, hydraulic, electromechanical and electropneumatic.

9. The apparatus of claim 1, where camera is positioned in the compartment to capture an image of the individual opening the lid.

10. The apparatus of claim 1, where camera stores the image data locally and transmits to a remote data storage device.

11. The apparatus of claim 1, where the container has at least one sensor detecting entry and communicating with an alarm.

12. The apparatus of claim 1, where the container has an alarm that is activated upon unauthorized entry into the container.

13. The apparatus of claim 1, where a seal is positioned between the lid and the walls.

14. The apparatus of claim 1, where the container is rigidly affixed to an external anchor point.

15. The apparatus of claim 1, where the temperature control is selected from passive and active.

16. The apparatus of claim 15, where the passive temperature control is insulation.

17. The apparatus of claim 15, where the active temperature control is a temperature controller.

18. The apparatus of claim 17, where the temperature controller comprises at least one cooling unit to cool the compartment and at least one heating unit to heat the compartment.

19. The apparatus of claim 17, where the temperature controller is programmable.

20. The apparatus of claim 19, where the temperature controller is programmable remotely and locally.

21. The apparatus of claim 17, where the temperature controller detects the compartment temperature and external (ambient) temperature.

22. The apparatus of claim 17, where the temperature controller notifies owner when a programmable setting has been reached or exceeded.

23. The apparatus of claim 17, where the temperature controller sets the temperature in the compartment to a selected value for an expected delivery time.

24. The apparatus of claim 1, where a power is selected from alternating current (AC) and direct current (DC).

25. The apparatus of claim 24, where the system DC power source is a battery.

26. The apparatus of claim 25, where the battery is charged from solar power and AC.

27. The apparatus of claim 1, where the container external lock is weather resistant.

28. The apparatus of claim 1, where the external lock is an electronic lock.

29. The apparatus of claim 28, where the electronic lock is selected from digital, proximity, remote, scan, and biometric.

30. The apparatus of claim 28, where the electronic lock may be unlocked remotely with a communication device.

31. The apparatus of claim 30, where the communication device is selected from a group comprising a desktop, laptop, smart phone, tablet, smart watch, scanner, delivery tracker, key fob, drone, and a card.

32. The apparatus of claim 31, where the wireless external lock communication is selected from a group of Wi-Fi™, Bluetooth™, infrared, mobile communications, drone, and near-field communications.

33. The apparatus of claim 30, where the external lock detects tampering and provides notification to a communication device.

34. The apparatus of claim 30, where delivery code is scanned to unlock the delivery-container.

35. The apparatus of claim 34, where the delivery code is selected from a universal product code and quick response code.

36. The apparatus of claim 1, where the deployable compartment lock is integrated into the container whereupon locking the container locks the deployable compartment lock.

37. The apparatus of claim 1, where the deployable compartment lock is adjustable.

38. The apparatus of claim 1, where the deployable compartment lock is selected from an interference lock and a friction lock.

39. The apparatus of claim 1, where a system controller monitors operations, communicates with internal and external devices.

40. The apparatus of claim 39, where the system controller is selected from a group comprising analog components, a microprocessor, a microcontroller, and a programmable logic-controller.

41. The apparatus of claim 39, where the system controller power source is alternating current (AC) and direct current (DC).

42. The apparatus of claim 40, where the system controller DC power source is a battery.

43. The apparatus of claim 42, where the battery is charged by solar power and AC power.

44. The apparatus of claim 40, where a system controller wireless communication is selected from Wi-Fi™, Bluetooth™, infrared, mobile communications, radio frequency identification and near-field communication.

45. The apparatus of claim 1, where a system controller regulates the internal temperature of the compartment.

46. The apparatus of claim 1, where a system controller detects the delivery container lock being locked or unlocked.

47. The apparatus of claim 1, where a system controller detects the position of the lid.

48. The apparatus of claim 1, where a system controller detects the delivery to or removal from a compartment.

49. The apparatus of claim 1, where a system controller timestamps the delivery to or removal from a compartment.

50. The apparatus of claim 1, where a system controller provides notification to the owner upon delivery and removal.

51. The apparatus of claim 1, where a system controller collects and stores video data upon opening the lid.

52. The apparatus of claim 51, where video data is stored locally, transmitted to an external storage device and transmitted to a communication device.

53. The apparatus of claim 1, where the deployable external compartment is selected from mesh or solid material.

54. A delivery container for temporarily securely storing deliveries and limiting access comprising:

a. at least one container having—
   i. horizontal bottom,
   ii. a plurality of vertical sidewalls,
   iii. at least one receiving compartment defined therein,
   iv. a lid hinge, and,
   v. a horizontal lid attached to a vertical wall substantially covering the receiving compartment in the closed position;

b. an anchor point positioned within the compartment for securing a deployable external compartment;

c. at least one insulated compartment;

d. at least one external lock;

e. at least one deployable external compartment for deliveries having—
   i. at least one flexible sidewall,
   ii. at least one receiving compartment defined therein, and
   iii. at least one integrated locking system securing the deployable compartment to the container, whereby a delivery person unlocks the delivery container, places a delivery in the appropriate compartment based on the package type such as frozen or heated food and locks the delivery container unless the package is too large or an odd shape that will not fit in the delivery container, then delivery person deploys the external compartment and places the odd package inside the external compartment and secures the odd package to delivery container utilizing an integrated lock and closes the lid to activate the external compartment lock, and locks the delivery container.

55. The apparatus of claim 54, where the delivery container has a plurality of compartments.

56. The apparatus of claim 55, where at least one compartment is heated.

57. The apparatus of claim 55, where at least one compartment is refrigerated.

* * * * *